United States Patent [19]

Tuggle

[11] 4,327,933

[45] May 4, 1982

[54] SAILBOAT CARRIER

[76] Inventor: William E. Tuggle, 212 65th St., Virginia Beach, Va. 23451

[21] Appl. No.: 134,242

[22] Filed: Mar. 26, 1980

[51] Int. Cl.[3] ..... B60P 3/10

[52] U.S. Cl. ..... 280/414.2; 280/35; 280/47.13 B; 114/344

[58] Field of Search ..... 280/414 A, 414 R, 47.13 B, 280/47.13 R, 47.14, 47.15, 63, 35, 107, 1; 9/1.2; 244/101, 105

[56] References Cited

U.S. PATENT DOCUMENTS

| | | | |
|---|---|---|---|
| 2,108,747 | 2/1938 | Glover | 244/105 X |
| 2,354,845 | 8/1944 | Thornton | 280/47.13 B |
| 3,159,410 | 12/1964 | Raymond | 280/414 A |
| 3,188,108 | 6/1965 | Davis | 280/47.13 B |
| 3,754,772 | 8/1973 | Carn | 280/47.13 B |
| 3,771,809 | 11/1973 | Carn | 280/47.13 B |
| 3,863,945 | 2/1975 | Dunstan | 280/47.13 R |
| 3,977,690 | 8/1976 | Carn | 280/47.13 B |
| 4,114,772 | 9/1978 | Beelow | 280/414 R |
| 4,235,450 | 11/1980 | Conover | 280/414 A |
| 4,243,239 | 1/1981 | Whitney | 280/414 A |
| 4,243,242 | 1/1981 | Waits | 280/414 A |

*Primary Examiner*—John A. Pekar

*Attorney, Agent, or Firm*—Pollock, Vande Sande & Priddy

[57] ABSTRACT

A carrier (22) for twin-hulled vessels is disclosed which includes an axle (24), a pair of soft-tired wheels (26, 28) mounted on the axle, a pair of cradles (42, 44) for the hulls (12, 14) of the vessel and bearing blocks (50, 52) extending downwardly from each cradle for slidably, rotatably receiving the axle. The carrier permits easy movement of such vessels across soft surfaces such as beach sand and also is easily assembled and disassembled prior to use or storage.

12 Claims, 4 Drawing Figures

SAILBOAT CARRIER

DESCRIPTION

Technical Field

This invention relates in general to wheeled carriers of the type used to transport small water craft. More particularly, the invention concerns a type of wheeled carrier especially suited for transporting a twin-hulled vessel, or catamaran, across a soft surface such as beach sand, without damaging the hulls of the vessel.

Background Art

In recent years, a type of lightweight catamaran sailboat has achieved considerable popularity. Such boats typically comprise a pair of pontoons or hulls of plastic and rigid foam construction with a fiber glass outer layer. The hulls are joined by a tubular metal frame which supports a platform or trampoline type structure on which the occupants sit while sailing, the mast on which the sail and related rigging are mounted and other paraphernalia which are required to sail the craft. One very attractive feature of such boats is their low weight which makes it possible to remove them from the water rather easily. However, when the boats are used where no dock is available, such as at many beaches, a common practice is to drag the boat on its hulls across the surface of the sand and into the water. Such dragging requires considerable effort even though such boats typically weigh only 250 to 350 pounds. Moreover, the sand eventually abrades the bottoms of the pontoons so that periodic expensive refinishing is required.

To simplify the task of moving the boat across the sand, wheeled carriers have been developed on which the boat can be pulled to the water. Such carriers as are known to the applicant have had rather large, cumbersome wheel and axle structures which are difficult to stow when the carrier is not needed. Moreover, the use in prior art carriers of rather conventional tire structures which tend to sink into the sand makes such carriers still rather hard to pull across the surface of the sand when loaded with a boat.

DISCLOSURE OF THE INVENTION

A primary object of the present invention is to provide an improved wheeled carrier for lightweight catamaran sailboats which facilitates moving such boats across soft surfaces such as beach sand.

Another object of the invention is to provide such a carrier which is easily disassembled into a minimum number of component parts small enough for convenient handling and storage, without tools, once width needs are established.

Yet another object of the invention is to provide such a carrier which is easily adapted to accommodate catamarans of differing widths.

A still further object of the invention is to provide such a carrier which when loaded is easier to move across a soft surface than prior art carriers.

These objects of the invention are given only by way of example; thus, other desirable objectives and advantages inherently achieved by the disclosed structure may occur to those skilled in the art. Nonetheless, the scope of the invention is to be limited only by the appended claims. In a preferred embodiment of the invention, the carrier for catamaran boats includes an axle having a pair of wheels mounted thereon at spaced locations. Outboard of the wheels, first and second cradles are provided which are sized to receive a portion of the keel of respective hulls of such sailboats. On the underside of each of these cradles is mounted a bearing block through which the axle extends slidably and rotatably. Since the cradles and their associated bearing blocks are free to slide along the axle, the carrier readily adapts itself to boats of differing widths. Though it is preferred that the axle be free to rotate within the bearing blocks, it is also within the scope of the invention to mount the cradles slidably, but not rotatably, on the axle; and to mount the wheels for rotation about the axle. Adjustable stops preferably are provided on the axially inner side of each wheel and optionally may also be provided on the axially outer side of each wheel, as desired, to maintain wheel position during movement and prevent contact by the wheels with the adjacent structure.

The cradles preferably comprise a pair of upwardly diverging retaining walls extending from the respective bearing blocks. To facilitate movement across a soft surface such as beach sand, the wheels preferably comprise rather soft balloon-type tires which tend to spread out on a soft surface rather than to sink into it during movement. To provide added assurance that the hulls of the boat will remain in the cradles, securing devices such as buckles and belts or elastic bands may be used. Although it is possible to move a catamaran boat on a single assembly of axle, wheels and cradles, it is preferred to use two of such assemblies at opposite ends of the boat for stability during movement.

DETAILED DESCRIPTION OF THE PREFERRED EMBODIMENT

Figure 1:
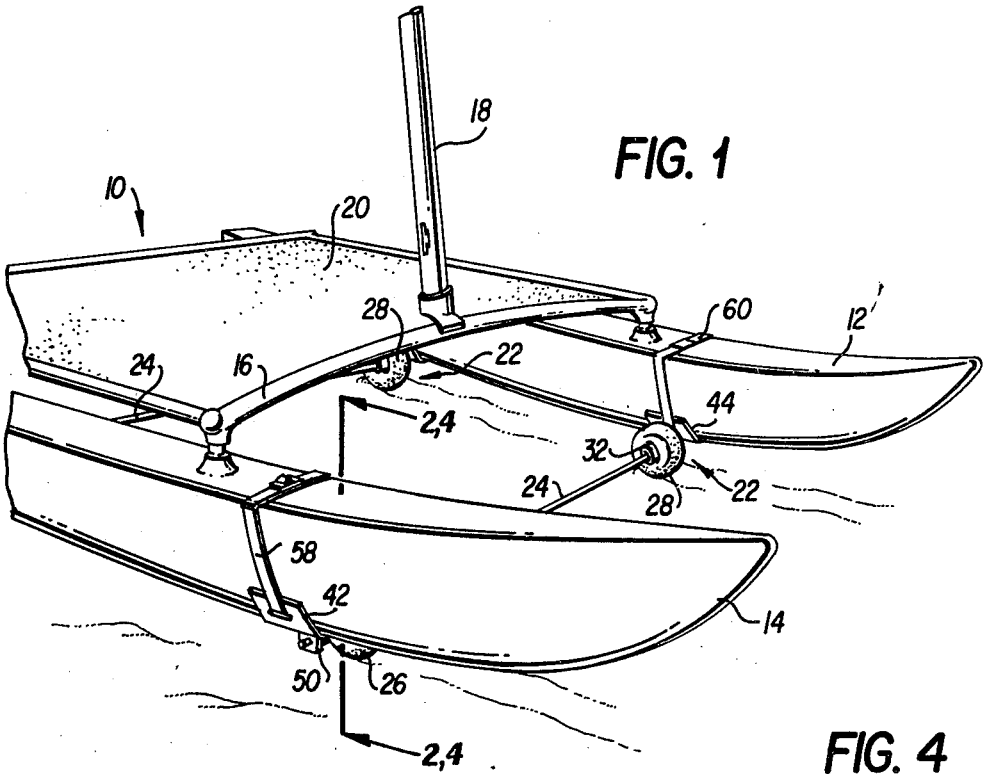
FIG. 1 shows a fragmentary perspective view of a catamaran sailboat as mounted on a pair of carriers according to the present invention.

The following is a description of a catamaran boat carrier according to the invention, reference being made to the drawings in which like reference numerals identify like elements of structure in each of the several figures.

Figure 2:
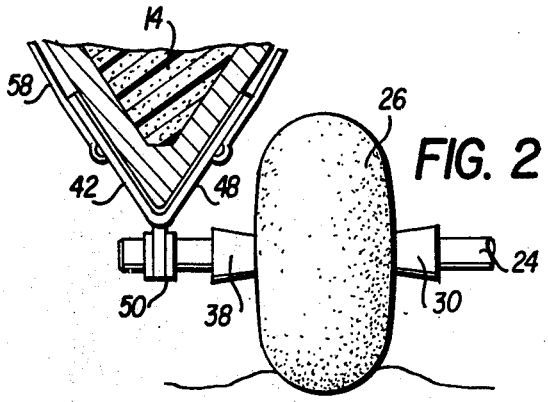
FIG. 2 shows a view, partially in section, taken along line 2,4—2,4 of FIG. 1 indicating the relative positions and geometries of the wheels, stops, bearing blocks and cradles when a sailboat is mounted on the cradles.
Figure 3:
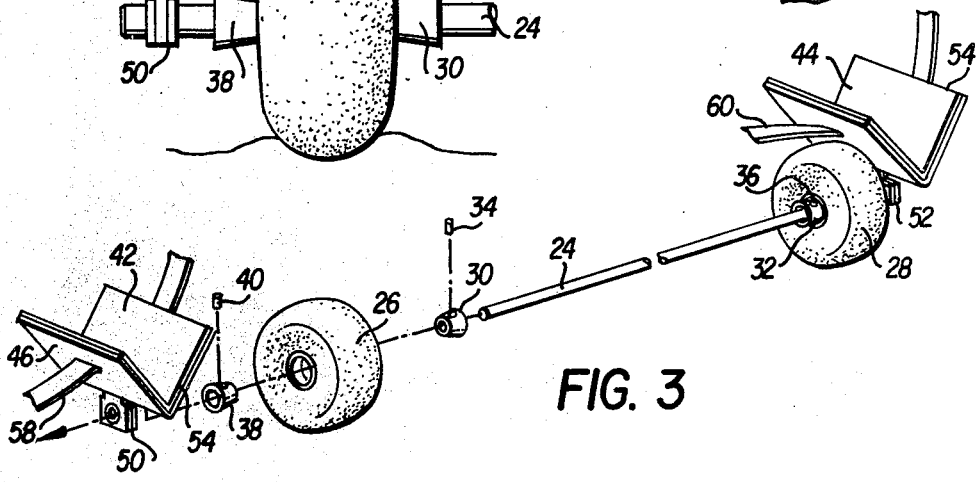
FIG. 3 shows a perspective, exploded view of a carrier according to the present invention.

Referring to FIGS. 1 to 3, a conventional lightweight, twin-hulled vessel or catamaran 10 is shown which comprises a pair of hulls or pontoons 12, 14 joined in the usual manner by a rectangular rigid frame 16 which in turn supports the mast 18 with its associated rigging and a platform or trampoline 20. As indicated in FIG. 1, boat 10 is supported for movement across a soft surface such as beach sand by a pair of carriers 22 according to the present invention. These carriers each comprise an axle 24 on which a pair of wheels 26, 28 with soft, balloon-type tires are mounted at axially spaced locations set apart a distance somewhat less than the width of the sailboat between its hulls. The wheels may rotate with or about axle 24. The wheels are held against movement inwardly toward the center of axle 24 by a pair of stops 30, 32 secured in position on axle 24 by means such as set screws 34, 36. Stops 30, 32 are sized as necessary to bear against the hubs of wheels 26, 28. In place of separate stops 30, 32 as illustrated, a continuous sleeve surrounding shaft 24 between the wheels could also be used. Movement of wheels 26, 28 outwardly toward the ends of axle 24 may be prevented by an optional stop 38 secured in place at each end of axle 24 by means such as a set screw 40. However, in order to facilitate assembly and disassembly of the carrier before and after use, stop 38 may be omitted so that any outward movement of wheels 26, 28 is limited by contact with a pair of elongated cradles 42, 44 positioned at the ends of shaft 24 to receive a portion of the keels of hulls 12, 14. Cradles 42, 44 may be made from metal, plastic, wood or other suitable material and comprise a pair of upwardly diverging retaining walls 46, 48 which define a generally V-shaped support. Of course, cradles shaped to closely fit different hull geometries also may be used. Depending from the undersides of cradles 42, 44 are bearing blocks 50, 52 which preferably are slidably, rotatably received on the ends of axle 24. The bearings should be of the sealed type to protect against entry of sand and water during use. Alternatively, wheels 26, 28 may be permitted to rotate on axle 24 and bearing blocks 50, 52 may be replaced by simple axle supports (not illustrated) configured to allow sliding, but not rotating, movement of axle 24. For example, splined or keyed axle supports could be used in such an alternate configuration. If desired, the interior surfaces of cradle 42, 44 may be provided with an elastomeric liner 54 or similar soft liner in order to protect the surface finish of hulls 12, 14.

Figure 4:
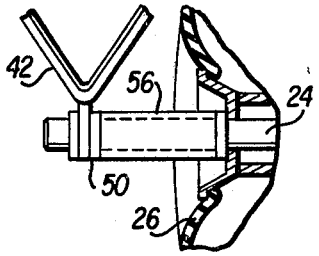
FIG. 4 shows a view taken along line 2,4—2,4 of FIG. 1 indicating an alternative assembly according to the invention in which spacers are provided between the bearing blocks and the wheels.

FIG. 4 shows an alternative assembly of the carrier according to the present invention in which a sleeve 56 is positioned on shaft 24 between wheels 26, 28 and bearing blocks 50, 52 to prevent movement of wheels 26, 28 into contact with cradles 42, 44 or hulls 12, 14. Finally, means such as straps and buckles 58, 60 may be attached to the opposite sides of cradles 42, 44 for the purpose of securely attaching the catamaran to its carrier.

In use, carrier 22 is easily assembled by first positioning stops 34, 36 on axle 24 at a distance chosen to accommodate the particular catamaran sailboat to be carried. Then wheels 26, 28 are slid onto axle 24 and if desired, optional stops 38 or 56 are placed outboard of the wheels. Then cradles 42, 44 are placed on the outer ends of axle 24 so that axle 24 can rotate in bearing blocks 50, 52. To move the sailboat onto the carrier, it is necessary only to raise the end of one hull at a time and then slide the carrier beneath the boat and lower the hull into place on its cradle. In practice, it has been found convenient to support the hull briefly on means such as a forked prop while a cradle is positioned beneath the keel. With the sailboat mounted on a pair of such carriers as shown in FIG. 1, it can be moved rather easily through sand by a pair of small children; whereas, prior art carriers known to the applicant usually required the effort of a pair of grown men. After the sailboat has been placed in the water, the carrier is easily disassembled and stowed in an automobile trunk or the like, except for the rather long axles which may be placed inside the main sail or sail bag. Each carrier weighs approximately 25 to 30 pounds, primarily depending on wheel and tire type used.

Having described my invention in sufficient detail to enable those skilled in the art to make and use it,

I claim:

1. An improved carrier for twin hulled vessels, comprising:

an axle;

a pair of wheels mounted on said axle at spaced locations;

first and second cradle means for receiving a portion of the keel of a respective hull of such vessels; and first and second bearing means, one affixed to the underside of each of said cradle means, said bearing means being slidable along said axle at locations spaced outboard of said wheels, whereby the spacing between said cradle means may be adjusted.

2. A carrier according to claim 1, wherein each of said cradle means comprises a pair of upwardly diverging retaining walls extending from its respective bearing means.

3. A carrier according to claim 1, wherein said wheels comprise soft balloon-type tires.

4. A carrier according to claim 1, further comprising stop means on said axle for limiting movement of said wheels therealong.

5. A carrier according to claim 1, further comprising means attached to said cradle means for securing the hulls of such vessels to said cradle means.

6. A carrier according to claim 1, wherein said axle is free to rotate within said bearing means.

7. An improved wheeled carrier for objects or different widths, comprising:

an axle;

a pair of wheels mounted on said axle at spaced locations;

first and second cradle means for receiving spaced portions of such objects; and first and second bearing means, one affixed to the underside of each of said cradle means, said bearing means being slidable along said axle at locations spaced outboard of said wheels, whereby the spacing between said cradle means may be adjusted.

8. A carrier according to claim 7, wherein each of said cradle means comprises a pair of upwardly diverging retaining walls extending from its respective bearing means.

9. A carrier according to claim 7, wherein said wheels comprise soft balloon-type tires.

10. A carrier according to claim 7, further comprising stop means on said axle for limiting movement of said wheels therealong.

11. A carrier according to claim 7, further comprising means attached to said cradle means for securing such objects to said cradle means.

12. A carrier according to claim 7, wherein said axle is free to rotate within said bearing means.

* * * * *